United States Patent [19]

Byers

[11] 4,078,312

[45] Mar. 14, 1978

[54] DRAFTING PARALLEL BAR

[76] Inventor: Thomas L. Byers, 3004 SE. 21, Oklahoma City, Okla. 73115

[21] Appl. No.: 811,225

[22] Filed: Jun. 29, 1977

[51] Int. Cl.[2] ..... B43I 13/02
[52] U.S. Cl. ..... 33/80
[58] Field of Search ..... 33/80, 81

[56] References Cited

U.S. PATENT DOCUMENTS

| | | | |
|---|---|---|---|
| 2,804,691 | 9/1957 | Justis | 33/80 |
| 3,892,041 | 7/1975 | Adair | 33/80 |

FOREIGN PATENT DOCUMENTS

| | | | |
|---|---|---|---|
| 638,598 | 6/1950 | United Kingdom | 33/80 |

*Primary Examiner*—Harry N. Haroian
*Attorney, Agent, or Firm*—Robert K. Rhea

[57] ABSTRACT

A parallel bar including a base member adapted to be flatly positioned on the surface of a drawing board in overlying relation for movement in opposing directions along guiding cables transversely of the board. The base member is provided with a scale and a slider having a hairline and securable to one of the bar guide cables for indicating increments of movement of the bar with respect to the surface of the drawing board.

5 Claims, 7 Drawing Figures

DRAFTING PARALLEL BAR

BACKGROUND OF THE INVENTION

1. Field of the Invention

The present invention relates to drafting instruments and more particularly to a parallel bar having a slider indicating increments of movement of the bar with respect to the drawing board.

2. Description of the Prior Art

Drafting instruments commonly known as parallel bars, such as is disclosed by U.S. Pat. Nos. 1,075,067 and 1,310,596, as well as other types presently in use, are well known. U.S. Pat. No. 1,310,596 discloses a parallel bar movement indicator secured to the guide cable but neither of these patents nor other types of parallel bars presently in use, so far as I know, disclose a hairline slider which may be selectively positioned along the bar for indicating increments of movement of the parallel bar with respect to a base line or reference point when the bar is moved along the Y-axis of a rectangular coordinate.

This invention provides a measuring member scale supported by the base of a parallel bar and further includes a slider containing a hairline with the slider secured to one of the parallel bar guide cables so that the slider is moved toward one end or the other of the parallel bar as it is moved in respective directions along the Y-axis. The distance of movement is indicated by the position of the hairline with respect to the underlying parallel bar supported scale.

SUMMARY OF THE INVENTION

An elongated extruded bar base, having lateral parallel flanged edges, is cut to the length of a drawing board on which it is to be mounted. The bar base is generally upwardly open channel-like in transverse section and is characterized by upper and lower longitudinally coextensive pairs of slots arranged in confronting relation. A pair of sheet metal brackets, each journalling a pair of pulleys, are slidably inserted into the lower pair of slots at the respective ends of the bar base. Parallel bar guide cables are entrained over the pulleys and secured to a drafting board in a conventional manner. A brake member, supported by each pulley bracket and frictionally engaging the guide cables, maintains the bar base in position on an inclined drawing board. An elongated planar scale member, containing scale indicia, is supported by the lowermost pair of slots between the pulley brackets. A slider, formed of transparent material, is slidably received by the upper pair of slots for to and fro movement between the ends of the bar base. The slider contains a hairline extending transversely of the bar base. A releasable clamp member, supported by the slider, grips one of the guide cables in a clamping action so that the slider is moved toward one end of the bar base in response to movement of the parallel bar toward one edge of the drawing board. An elongated scale equipped straight edge is releasably engageable with the lateral flanges of the bar base.

The principal objects of the invention are to provide an elongated extruded base member for parallel bars which may be cut to the length of a drafting board with which it is to be used and provide pulley journalling brackets engageable with the respective ends of the base and further including a hairline slider overlying scale indicia and moved by movement of the parallel bar for indicating increments of lateral movement of the base member with respect to the drawing board.

DESCRIPTION OF THE PREFERRED EMBODIMENTS

Figure 1:
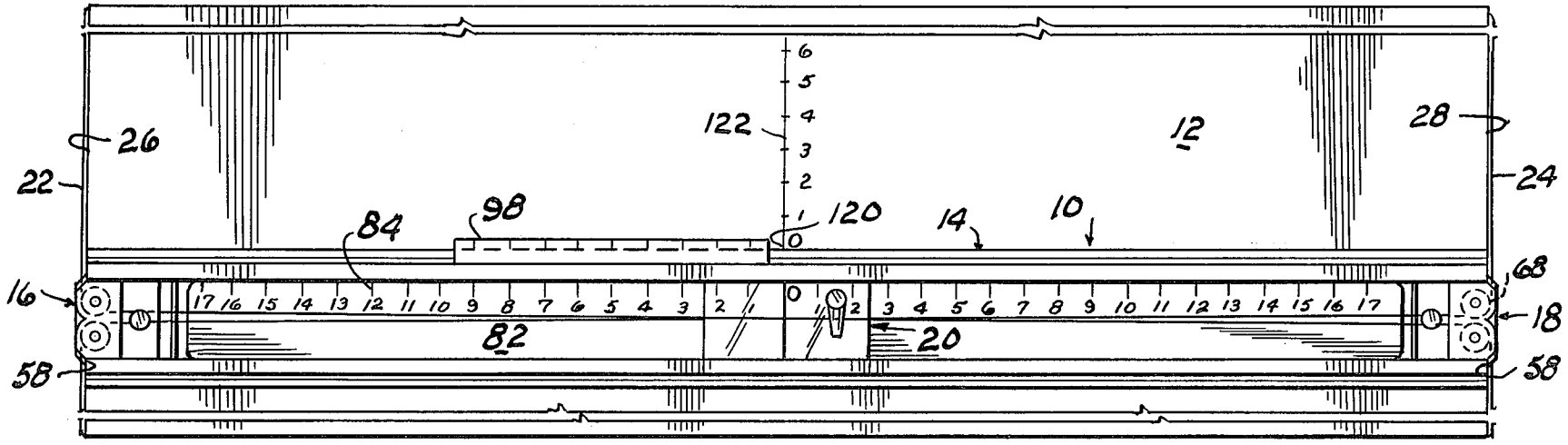
FIG. 1 is a top view of the parallel bar when mounted on a drawing board.
Figure 2:
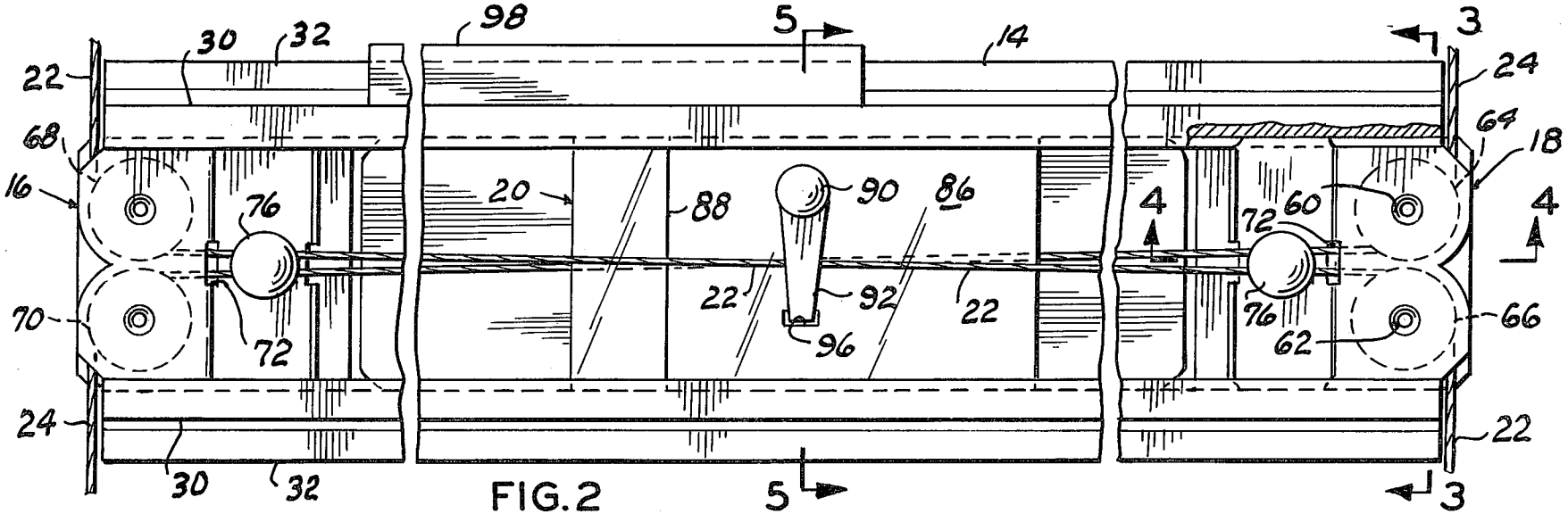
FIG. 2 is a top view, to a larger scale, of the parallel bar, per se.
Figure 3:
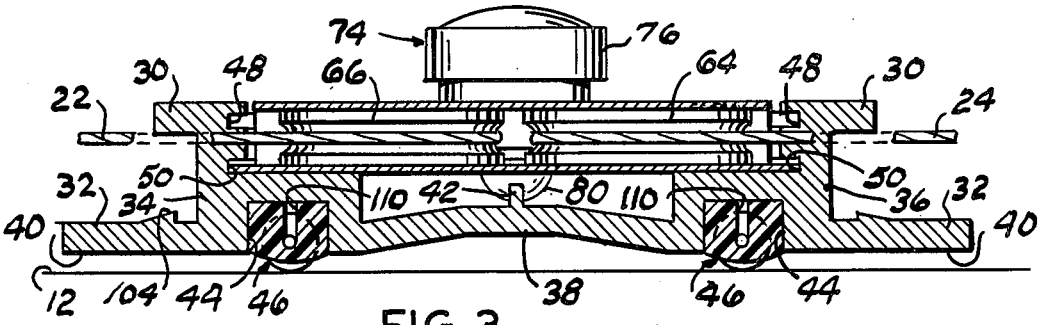
FIGS. 3, 4 and 5 are vertical cross sectional views taken substantially along the lines 3—3, 4—4 and 5—5, respectively, of FIG. 2.

Like characters of reference designate like parts in those figures of the drawings in which they occur.

In the drawings:

The reference numeral 10 indicates the parallel bar, as a whole, longitudinally mounted in overlying relation on the upper surface of a drawing board 12. The parallel bar 10 comprises a bar base 14, pulley supported bracket means 16 and 18 and a measurement indicating means 20. The parallel bar further includes guide cables 22 and 24 entrained over pulleys in the bracket means 16 and 18 and connected with the drawing board, as presently explained.

The bar base 14 preferably comprises a length of extruded metallic material having a longitudinal dimension substantially equal with respect to the distance between the ends 26 and 28 of the drawing board 12. The bar base 14 is substantially upwardly open channel-shaped in transverse section characterized by upper and lower coextensive horizontal laterally projecting flanges 30 and 32 respectively projecting outwardly from oppositely disposed parallel upstanding leg members 34 and 36. The bight portion 38 of the bar base is bowed upwardly with respect to the horizontal plane defined by the depending surface 40 of the lowermost lateral flanges 32. The upper surface of the bight portion is centrally provided with a coextensive upstanding projection or ridge 42, for the purposes presently explained.

The depending surface of the bar base is provided with a spaced-apart pair of coextensive downwardly open slots 44, substantially square when viewed from one end of the bar base and disposed at the juncture of the bight portion with the respective lowermost lateral flanges 32, for receiving antifriction members 46 more fully described hereinbelow. The inward surface of the bar base legs 34 and 36 are provided with upper and lower pairs of grooves 48 and 50 respectively arranged in horizontally aligned confronting relation.

Figure 4:
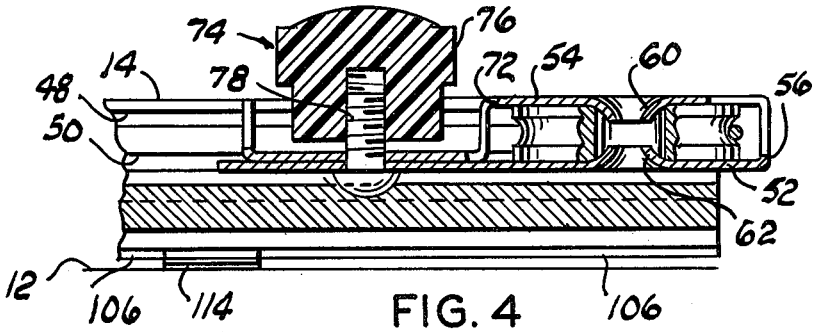
Figure 5:
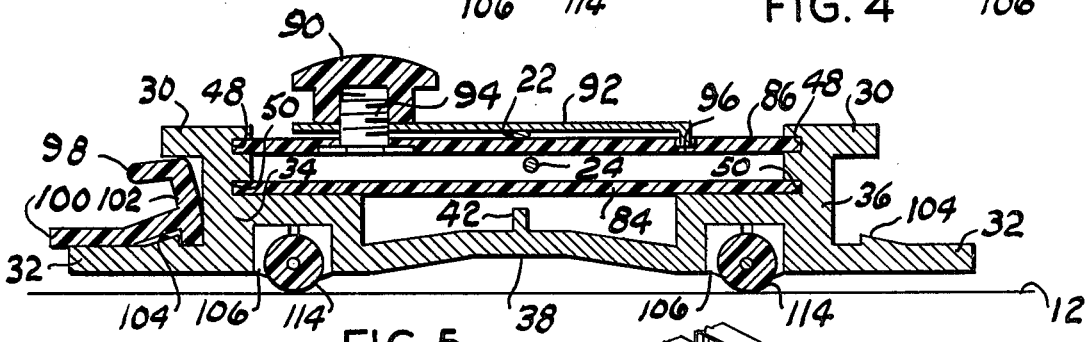
Figure 7:
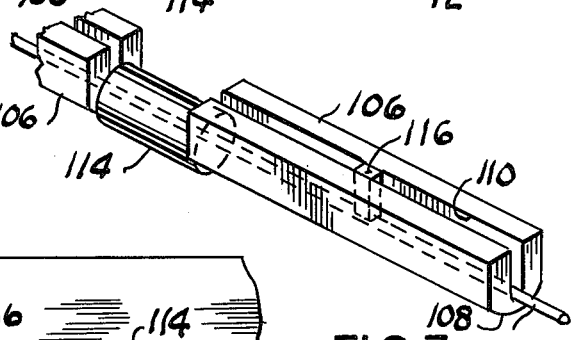
Figure 6:
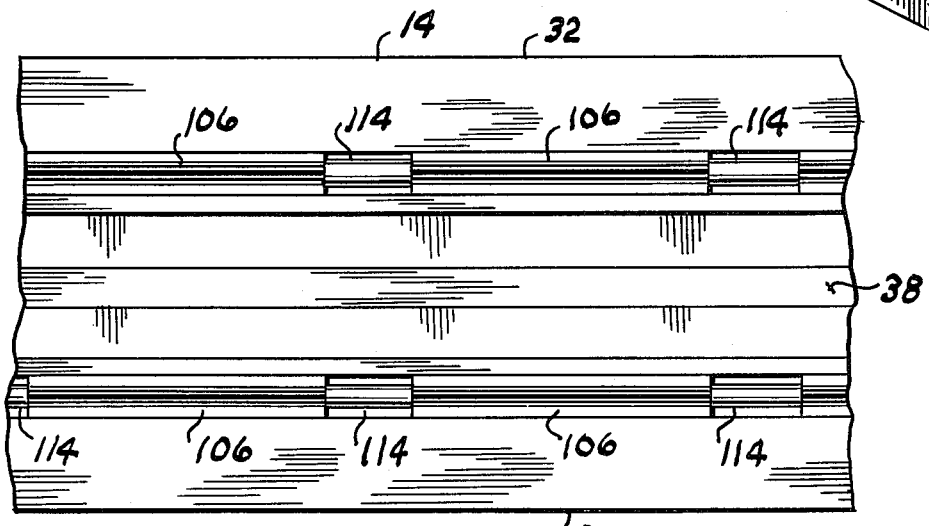
FIG. 6 is a fragmentary bottom view of an intermediate portion of the bar; and, FIG. 7 is a fragmentary perspective view of antifriction bar supporting members.

The pulley bracket means 16 and 18 are substantially mirror images of each other and only the bracket means 18 will be described in detail in the interest of brevity. The pulley bracket means 18 comprises an elongated length of metallic sheet material doubled back upon itself, in the manner best shown by FIG. 4, to form a bracket base wall 52 and bracket top wall 54 joined by an end wall 56. Transversely the width of the bracket base wall 52 is such that its lateral marginal edge portions are cooperatively received horizontally by the lowermost pair of grooves 50. The thickness of the sheet material forming the pulley bracket is such that two thicknesses thereof may be slidably received by the pair of grooves 50 when disposed in face to face contact. An intermediate portion of the bracket base projects laterally of the bracket at opposing ends of the end wall 56 to form stops 58 abutting the end of the bar base 14 to prevent movement of the pulley bracket toward a medial portion of the bar base. Spaced inwardly from the end wall 56 the lower and upper bracket base wall 52 and top wall 54 are struck inwardly to form two laterally aligned pairs of hubs 60 and 62 for respectively journalling a pair of pulleys 64 and 66. Another pair of pulleys 68 and 70 are identically journalled by the other bracket means 16. The end portion of the bracket top wall 54 opposite the end wall 56 is turned downwardly and laterally dimensioned to flatly overlie the cooperating end portion of the bracket base wall 52 and be nested by the pair of grooves 50. The bracket top wall 54 is centrally apertured, as at 72, for passage of the guide cables 22 and 24, as presently explained.

Brake means 74 comprising a knob 76 is threadedly engaged with a round head machine screw 78 projecting upwardly through the bracket bottom and top walls 52 and 54 with the slot in the head 80 of the machine screw receiving an intermediate portion of the ridge 42 to prevent rotation of the screw 78 about its longitudinal axis. The cables 22 and 24 underlie the depending end of the knob 76 on opposing sides of the screw 78 and are impinged against the bracket by the knob 76 when tightened on the screw. The cables 22 and 24 are connected with the drawing board in a manner conventional with mounting parallel bars. The cable 22 is entrained around the pulley 66 and extends longitudinally of the bar base 14 and is entrained around the pulley 68 to extend toward the corner of the board 12 opposite its point of beginning. The cable 24 is entrained around the pulley 70 and extends longitudinally of the bar base 14 and is entrained around the pulley 64 in a similar manner. The cables 22 and 24 cross intermediate the ends of the bar base.

An elongated planar scale member 82, having a length extending between the inward limits of the pulley bracket means 16 and 18, extends transversely between the lower pair of slots 50 beneath the cables 22 and 24. The upper surface of the scale member is provided with a plurality of scales or indicia begining at a zero position or point medially its ends and scored by a series of ascending numerals extending toward the right and left, as viewed in FIG. 1.

The indicating means 20 comprises a rectangular section of transparent plastic material 86 having a transverse width slidably received by the upper pair of grooves 48 for movement toward and away from respective ends of the scale member 82. The slider 86 is provided with a transverse hairline 88, for the purposes presently explained. A cable clamp, comprising a control knob 90 projecting through one end of a clamp arm 92 overlying the slider and threadedly engaged with a bolt 94, projecting vertically through the slider 86, impinges an intermediate portion of one of the cables, for example, the cable 22 entrained across the upper surface of the slider 86, for the purposes presently explained. The end of the clamp arm 92, opposite the knob 90, projects downwardly into a recess 96, formed in the upper surface of the slider 86, to prevent rotation of the clamp arm 92 about the vertical axis of the bolt 94 when the knob is loosened or tightened.

A guide or straight edge rule 98, having indicia scored thereon along one marginal edge 100, is frictionally received by its other substantially U-shaped edge portion 102 between the confronting surfaces formed by the bar base lateral flanges 30 and 32 wherein a coextensive upstanding lug 104, formed on the upper surface of the lower flange 32, retains the rule 98 in position.

The antifriction means 46, comprising a plurality of elongated sections 106, preferably formed from a plastic material, having a depending arcuate surface 108 engageable with the upper surface of the drawing board 12, are longitudinally disposed within the downwardly open slots 44. Each of the sections 106 are provided with a coextensive upwardly open slot 110 for receiving an elongated length of spring wire, such as a piano wire 112. A cylindrical roller 114, of selected length and coaxially journalled by the wire 112, is interposed between the ends of adjacent sections 106. The depth of the section slots 110 and the diameter of the roller 114 is such that a peripheral portion of the roller 114 projects downwardly with respect to the lowermost limit of the arcuate surface 108 so that the rollers normally contact the upper surface of the drawing board and support the parallel bar above the upper surface of the board during movement transversely of the board 12. Medially its length each section 106 is provided with a plug member 116 frictionally engaging the walls forming the slot 110 for maintaining the wire 112 in contact with the inward limit of the slot. The resilient spring-like characteristic of the wire 112 permits the wire to spring upwardly within the slot 110 between the positions of the plugs 116 by pressure manually applied to the upper surface of the bar so that the arcuate surfaces 108 of the antifriction sections 106 contact the upper surface of the drawing board.

OPERATION

In the operation, the parallel bar 10 is assembled and installed on the drawing board 12. A zero reference or point of beginning 120 is located on drawing paper overlying the drawing board and a line 122 divided into scale increments equalling one of the scales on the scale member 82 may be drawn on the drawing paper along the Y-axis transversely of the drawing board, if desired. With the knob 90 loosened one lateral edge of the bar base 14 is disposed coincident with the point of beginning 120. The indicator means 20 is disposed so that the hairline 88 is longitudinally aligned with the point 120 and the scale line 122. The clamp 92 is tightened to impinge the cable 22. Thereafter, movement of the parallel bar 10 toward the respective longitudinal marginal edge of the drawing board moves the indicator means 20 to the right or left, as viewed in FIG. 1, wherein the indicator means, by moving the hairline position longitudinally of the scales on the scale member 82, indicates the distance of movement of the lateral edges of the bar base 14 with respect to the scale 122. Obviously, after using one point of beginning, for a portion of a drawing being made, a new reference point may be established at any position longitudinally or transversely of the drawing board and the indicator means 20 adjusted to coincide with the subsequent reference point.

The rule 98 provides a true edge and scale along either side of the bar base for drawing lines wherein a triangle, or the like, not shown, flatly contacting paper on the drawing board 12, may be disposed with one of the edge surfaces adjacent the edge of the bar base flange underlying the rule 98 and the triangle progressively moved manually in either direction longitudinally of the bar base 14 for drawing lines along another edge of the triangle in accordance with its position with respect to the scale indicia on the rule.

Obviously the invention is susceptible to changes or alterations without defeating its practicability. Therefore, I do not wish to be confined to the preferred embodiment shown in the drawing and described herein.

I claim:

1. In combination with a drawing board having means for supporting a parallel bar guide cable, the improvement comprising:

an elongated parallel bar overlying said board and extending between its opposing end limits, said bar being substantially channel shaped in transverse section having upstanding legs provided with upper and lower vertically spaced pairs of coextensive grooves respectively arranged in confronting relation;

bracket means supported by the lowermost pair of grooves at the respective ends of said bar;

a pair of bar pulleys supported by each said bracket means;

a scale member having a scale thereon supported by the lowermost pair of grooves between said bracket means;

bar guide cables supported by said board and entrained around said bar pulleys and extending longitudinally of said bar above said scale member in a manner to maintain said bar parallel with opposing edge limits of said board during movement of said bar with respect to said board; and, indicating means slidably supported by the uppermost pair of grooves and engageable with one of said cables for indicating increments of movement of said bar with respect to said board.

2. The combination according to claim 1 in which said indicating means comprises:

a slider formed from transparent material and having a hairline scored thereon extending transversely of said bar; and, clamp means supported by said slider for impinging an intermediate portion of said one cable against said slider.

3. The combination according to claim 2 in which said bracket means includes:

a top wall and a base wall having hub means for journalling said bar pulleys between said walls; and, brake means including a manually operated knob supported by said walls adjacent the position of said cables and moveable toward and away from said top wall for forcing said cables toward said top wall in a frictional binding action.

4. The combination according to claim 3 in which said bar is further characterized by coextensive flanges projecting laterally of said bar legs in vertically spaced parallel relation and further including:

an elongated scale rule releasably supported by one longitudinal edge portion between said flanges, the other longitudinal edge of said rule projecting laterally of said flanges.

5. The combination according to claim 4 and further including: antifriction means secured to said bar for normally supporting said bar in spaced relation with respect to the adjacent surface of said board.

* * * * *